US005639169A

United States Patent [19]

Aruga

[11] Patent Number: 5,639,169

[45] Date of Patent: Jun. 17, 1997

[54] PRINTER AND METHOD OF CONTROL

[75] Inventor: Kazuhisa Aruga, Suwa, Japan

[73] Assignee: Seiko Epson Corporation, Tokyo, Japan

[21] Appl. No.: 307,084

[22] Filed: Sep. 16, 1994

Related U.S. Application Data

[63] Continuation of Ser. No. 65,731, May 21, 1993, abandoned.

[30] Foreign Application Priority Data

May 22, 1992 [JP] Japan ..... 4-130261

[51] Int. Cl.[6] ..... B41J 11/50

[52] U.S. Cl. ..... 400/605; 400/61; 400/166

[58] Field of Search ..... 400/157.2, 157.3, 400/166, 167, 605, 708, 61, 76; 395/111, 112, 113, 114, 115

[56] References Cited

U.S. PATENT DOCUMENTS

| | | | |
|---|---|---|---|
| 4,510,505 | 4/1985 | Fukui | 346/76 |
| 4,687,356 | 8/1987 | Matsui | 400/157.3 |
| 4,797,017 | 1/1989 | Okouchi | 400/166 |
| 4,940,344 | 7/1990 | Wada | 400/157.2 |
| 5,201,591 | 4/1993 | Ueda | 400/166 |
| 5,214,750 | 5/1993 | Minowa | 395/111 |
| 5,263,994 | 11/1993 | Ueda | 400/157.3 |
| 5,398,305 | 3/1995 | Yawata et al. | 395/115 |

FOREIGN PATENT DOCUMENTS

| | | | |
|---|---|---|---|
| 0395189 | 10/1990 | European Pat. Off. | 400/157.3 |
| 33118 | 8/1984 | Japan | 400/157.2 |
| 255464 | 12/1985 | Japan | 400/61 |
| 79678 | 4/1986 | Japan | 400/61 |
| 079678 | 4/1986 | Japan | 400/157.3 |
| 263776 | 11/1986 | Japan | 400/157.2 |
| 132063 | 6/1988 | Japan | 400/157.3 |
| 23953 | 1/1991 | Japan | 400/157.2 |
| 93549 | 4/1991 | Japan | 400/157.2 |
| 208074 | 9/1991 | Japan | 400/61 |
| 115961 | 4/1992 | Japan | 400/61 |
| 2219768 | 12/1989 | United Kingdom | 400/157.3 |

*Primary Examiner*—John S. Hilten
*Assistant Examiner*—Steven S. Kelley
*Attorney, Agent, or Firm*—W. Glen Johnson; Eric B. Janofsky

[57] ABSTRACT

Method and apparatus for altering the length of time a print head in a dot-matrix type of printer mechanism receives driving voltage in accordance with the type of recording media being used by the printer, and preselected print head driving modes selected as a result of control commands provided by a host computer. The print head driving voltage is also measured and digitized, and then used along with the paper type as a parameter for altering the print mode. Memory elements can be used to establish print mode, print media, and drive voltage relationships for automatically selecting an optimum driving time interval in response to one of the selected parameters.

26 Claims, 8 Drawing Sheets

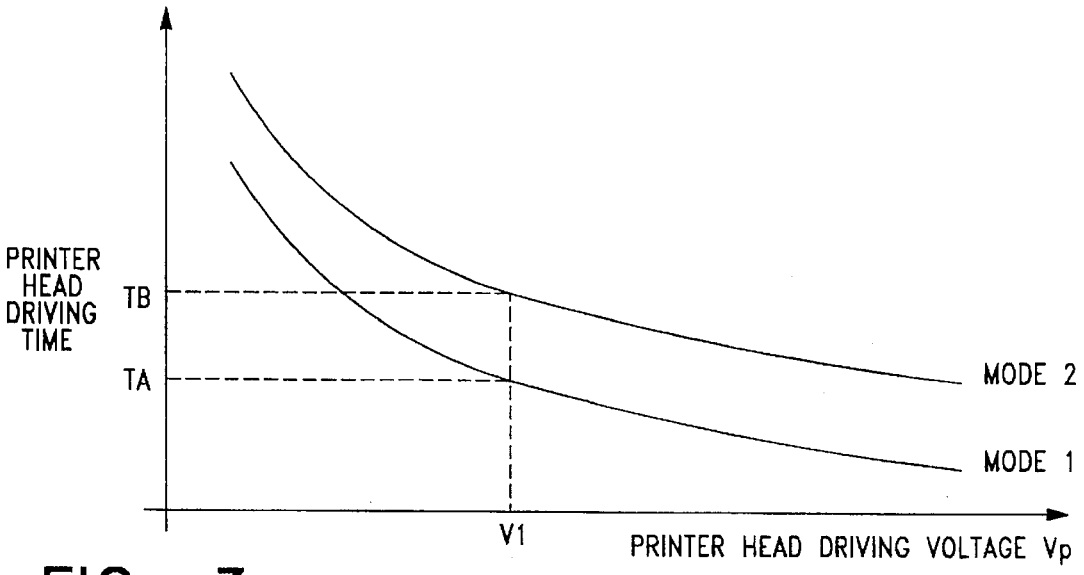
FIG.—3
GS E n 61
60
FIG.—6
ESC cO n 71
70
FIG.—7
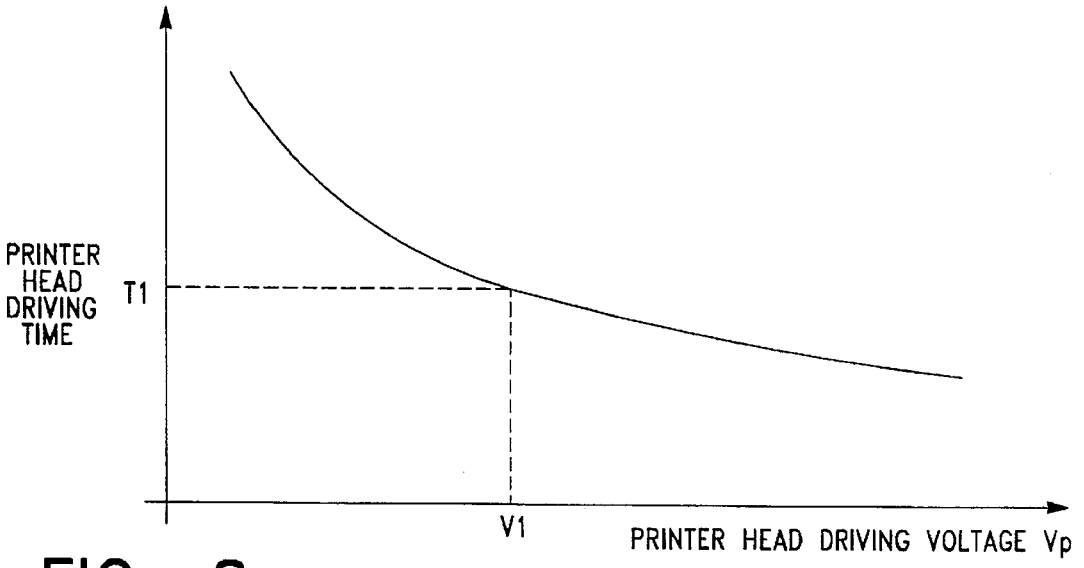
FIG.—8

| RECORDING PAPER | MODE | |
|---|---|---|
| | A | B |
| ROLL PAPER | DON'T CARE | DON'T CARE |
| CUT-SHEET PAPER | 0 | 1 |

| RECORDING PAPER | MODE | |
|---|---|---|
| | A | B |
| ROLL PAPER | 1 | 0 |
| CUT-SHEET PAPER | 0 | 1 |

| RECORDING PAPER | MODE | |
|---|---|---|
| | A | B |
| ROLL PAPER | 0 | 1 |
| CUT-SHEET PAPER | 0 | 1 |

PRINTER AND METHOD OF CONTROL

This is a continuation of application Ser. No. 08/065,731 filed May 21, 1993 now abandoned.

BACKGROUND OF THE INVENTION

1. Field of the Invention

The present invention generally relates to printers operated by host computers, and more particularly to a method and apparatus for controlling or altering the energy supplied to a printer print head in accordance with the type of recording media being used by the printer, especially for multiple paper-type POS printers. The invention further relates to a printer control structure that selectively adjusts the length of time driving voltage is applied to a print head in association with the type of recording paper being used.

2. Related Technological Art

In many printers of the computer and point-of-sale (POS) type, a print head is used that employs a series of small electromagnetic coils to operate a corresponding series of print pins, which are used to form an output image by striking an ink ribbon. The print head coils receive voltage signals that impart a driving voltage to the head to operate the coils and activate the pins. Other types of ink transfer structures are also sometimes employed which also rely on certain voltage input signals for activation.

In any case, the print head driving voltage is normally supplied from a power source or supply such as an AC power source that uses a switching regulator, a series regulator, or other type of DC stabilized control. Such power sources have a tolerance of about plus or minus ten percent (±10%) variation from a rated voltage value so that the actual driving voltage may differ from printer to printer. Furthermore, these stabilized power sources still have internal impedance or resistance, and the output voltage changes with changes in the load applied to the output. In addition, because of the impedance or resistance characteristics of any wiring connecting the power source to any print head drive circuit, or the coils, the driving voltage supplied to the print head drive is often not fixed but fluctuates to some extent. Therefore, assuming a relatively constant length of time for the application of the driving voltage to the print head, the resulting energy delivered to the print head does not remain constant but varies among various printers (static fluctuations) causing a print quality tolerance range or variation among the printers and is not constant within the individual printers (dynamic fluctuations), resulting in a certain level of unevenness in the printing output quality.

In order to make the energy imparted to the print head constant or more time invariant, the output of the power supply is controlled in a manner such that the length of time the voltage is applied is also varied to form a constant energy product. That is, when the voltage decreases to a lower energy per unit time value, the print head is driven for a longer period of time to provide the same net energy input. Conversely, the print head driving time is decreased when the driving voltage increases. A graphical representation of the relationship between print head driving voltage and driving time is presented in FIG. 8. From FIG. 8, it is readily apparent that the relationship between these two parameters has a roughly 1-to-1 correlation, as indicated by values for the driving period $T_1$ with respect to the driving voltage $V_1$ on the scale of pin driving voltage $V_p$. By controlling the print head so that the print head driving time is more suited to the print head driving voltage, printing quality is stabilized.

Unfortunately, this simplistic type of stabilization does not apply as well to printers that are capable of accommodating multiple types of print media or paper. That is, when the thickness and material of the recording paper being used varies, it is difficult to consistently obtain high print quality using the above method of matching driving voltage to driving time with a 1-to-1 or linear relationship. When a single sheet of paper is used in the printer, the print head driving time can be relatively short but when multiple layers of paper are used, as for multi-part forms and copies, the overall thickness of the print media is increased which also increases the energy required and the driving time must be increased.

Using the current technique, however, the same print head driving time is used for printing single paper sheets as is used for multiple sheets at a given, the same, print head driving voltage. This results in a driving time longer than necessary for single sheet paper, which increases the printing noise, overheats the print head, etc. On the other hand, if a driving time used for multi-sheet media is the same as that typically used for single sheet media, the ability to make copies is severely degraded.

In order to solve the energy transfer problem created by varying the media type, some printers are being developed which control the length of time voltage or power is applied to the print head according to the relative thickness of the recording paper being used. Examples of such printers are found in Japanese Laid-Open Patent Publications 53-118315 (Pat. No. 59-33118), 03-23953, and 03-93549.

The printer shown in the 53-118315 publication is provided with a detector for sensing the presence of a paper thickness indicator which is affixed to the recording paper. A print head activation time signal, typically a coil or magnet energizing time indicator signal, is generated which corresponds to the paper thickness and varies according to the thickness indicator sensed by the detector. This signal is used to automatically determine the thickness of the recording paper and control the energizing current, applied voltage, and driving time for the print head in accordance with the sensed paper thickness.

The printer shown in the 03-23953 publication, has a special motor which is used to adjust the gap between the printer platen and the print head, and a gap sensor to determine the current size of this gap. By measuring the difference in gap size between the point when no recording paper is present and when recording paper is present on the platen, a relative thickness for the recording paper is determined. From this determination of paper thickness, the length of time for driving the print head is selected.

As in the case of the printer shown in the 03-23953 publication, the printer shown in the 03-93549 publication has a motor which is used to adjust the platen gap and a sensor for determining the maximum physical gap size for the printer. Then, by measuring the distance by which the print head is moved from the maximum open gap configuration until it contacts the recording paper, such as by monitoring the rotation of the motor, the thickness of the recording paper can be detected. Once the thickness is measured, the length of time over which voltage is applied to the print head, as in applying power to coils used to drive pins, is adjusted accordingly.

However, the printers disclosed in these examples require a special mechanism to detect the thickness of the recording paper. That is, in the first example, a paper thickness indicator affixed to the recording paper along with an associated detector are each required. For the printers in the second and third examples above, both a platen gap adjustment motor and an associated gap sensor are required. Adding these special components or devices decreases the general usability of the recording paper. At the same time, reliability and ease of assembly are degraded due to a more complex mechanical configuration for the printers, and production costs are increased, which also hinders general acceptance in the marketplace.

Furthermore, while these printers can accommodate various paper thicknesses, they do not readily accommodate variations in other characteristics, such as variations in paper quality, that can effect printing. For example, even though a single sheet of paper and a multi-layered form have the same overall thickness, they require different print head energies or driving times, due to other surface characteristics, resiliency, etc., that differs between these media. The current state of the art printers cannot meet this need.

What is needed then, is a printer mechanism and a method of operation in which the print head driving time period is altered in response to fluctuations in the magnitude of the print head driving voltage. It would also be appropriate if the period of operation for the print head was optimized to readily accommodate differences in paper thickness and quality.

SUMMARY OF THE INVENTION

In order to solve the above and other problems in the art, one purpose of the present invention is to offer a printer that achieves optimum printing output in the presence of amplitude fluctuations in print head driver voltage signals.

Another purpose of the invention is to provide an optimum or more uniform output quality while accommodating a variety of print media.

One advantage of the invention is that it provides a printer controller that can adjust for variations in both recording media and print head driving voltage in a low complexity, low cost manner.

Another advantage of the invention is that once an optimum operating mode is determined, it can subsequently be automatically selected by merely selecting the media type.

These and other purposes, objects, and advantages of the invention are realized in a printer or a printer controller that selectively performs printing on at least two types of recording media by application of voltage signals to a dot-matrix type print head using a print head driver, in response to control commands received from a host computer. A control command interpreter is generally connected to an interface to receive and interpret control commands from the host computer. The interpreted or decoded commands are used by a driving time determination element or section to select a driving mode for the print head when a print mode control command is received, and then to determine a driving time to be used for the print head based on the driving mode selected. A print head driver controller connected to the driving time determination section activates the print head driver for a time interval based on the time determined, whenever a printing operation is to be executed by the printer.

A print head driving voltage measurement device is used to measure the magnitude of the voltage being used to drive the printer head, and this information is supplied to the driving time determination section to assist in selecting a driving mode for the print head. This monitoring of the voltage compensates for fluctuations in the energy delivered to the print head.

A method of operating a printer according to the invention includes the step of selecting a driving mode from either driving mode selection information included in a command specifically for driving mode selection or from information obtained from a recording media, or paper, selection command. The print head driving voltage being used by the print head driver is also measured. Both the print head driving voltage and the type of recording paper are used as parameters to further modify or determine the print head driving time, beyond the mode command.

When a driving mode selection command is input to the printer, a control command interpreter extracts the driving mode selection information and outputs it to a driving time determination section. The driving time determination section receives this mode information and retrieves a driving time from a plurality of such driving times which each correspond to a driving mode, stored in a driving time memory, and then outputs it to a print head drive controller. The print head drive controller uses this information to set a limit for the length of time over which it will operate the print head driver. Using this approach, it is possible to use a driving mode selection command to select an optimum print head driving time for the recording paper to be printed on.

When a recording paper selection command is input to the printer, the control command interpreter extracts recording paper selection information and outputs it to the driving time determination section. The driving time determination section converts the recording paper selection information to a driving mode selection, generally using a conversion element or converter such as one or more prestored look-up tables. The driving time is then determined in the same manner as described above. Even though only selection of the recording media might be specified, by selecting the media using this approach, the optimum driving time for the recording paper selected, is also achieved.

In further aspects of the invention, the amplitude of voltage being supplied to the print head is measured and used to select or retrieve a driving time from a table of driving times stored in a driving time memory, along with the driving mode determined by interpretation of the control command. The voltage value measured for the print head driving voltage is generally converted to a digital value and digital processing is performed to reduce susceptibility of processing to drive source voltage fluctuations and external disturbances. In this manner, an optimum print head driving time corresponding to both the type of recording paper selected and fluctuations in the driving voltage can be obtained.

A printer operating according to the invention can also select the driving mode by using either driving mode selection information included in the driving mode selection command or driving mode selection information obtained from the recording paper selection information included in the recording paper selection command. The driving mode selected by the last executed command becomes effective when printing operations are commenced.

Furthermore, when a driving mode selection command is executed after execution of the recording paper selection command, the driving time determination section is updated so that driving mode selection information included in the driving mode selection command and obtained from the recording paper selection command essentially match. Therefore, even if the driving mode corresponding to the recording paper is not initially an optimum mode, it is corrected using the driving mode selection command at least once, and a corrected optimum driving mode is be subsequently selected by merely selecting the type of recording media.

Other objects and attainments together with a fuller understanding of the invention will become apparent and appreciated by referring to the following description and claims taken in conjunction with the accompanying drawings, in which like parts are designated by like numbers.

BRIEF DESCRIPTION OF THE DRAWINGS

FIG. 3 illustrates a graphical representation of the relationship of typical print head driving time and applied voltage for separate print modes;

FIG. 6 illustrates an diagram of a command found useful in implementing the invention;

FIG. 7 illustrates a diagram of another command useful for implementing the invention;

FIG. 8 presents a graphical representation of print head driving time and applied voltage;

DESCRIPTION OF PREFERRED EMBODIMENTS

Figure 1:
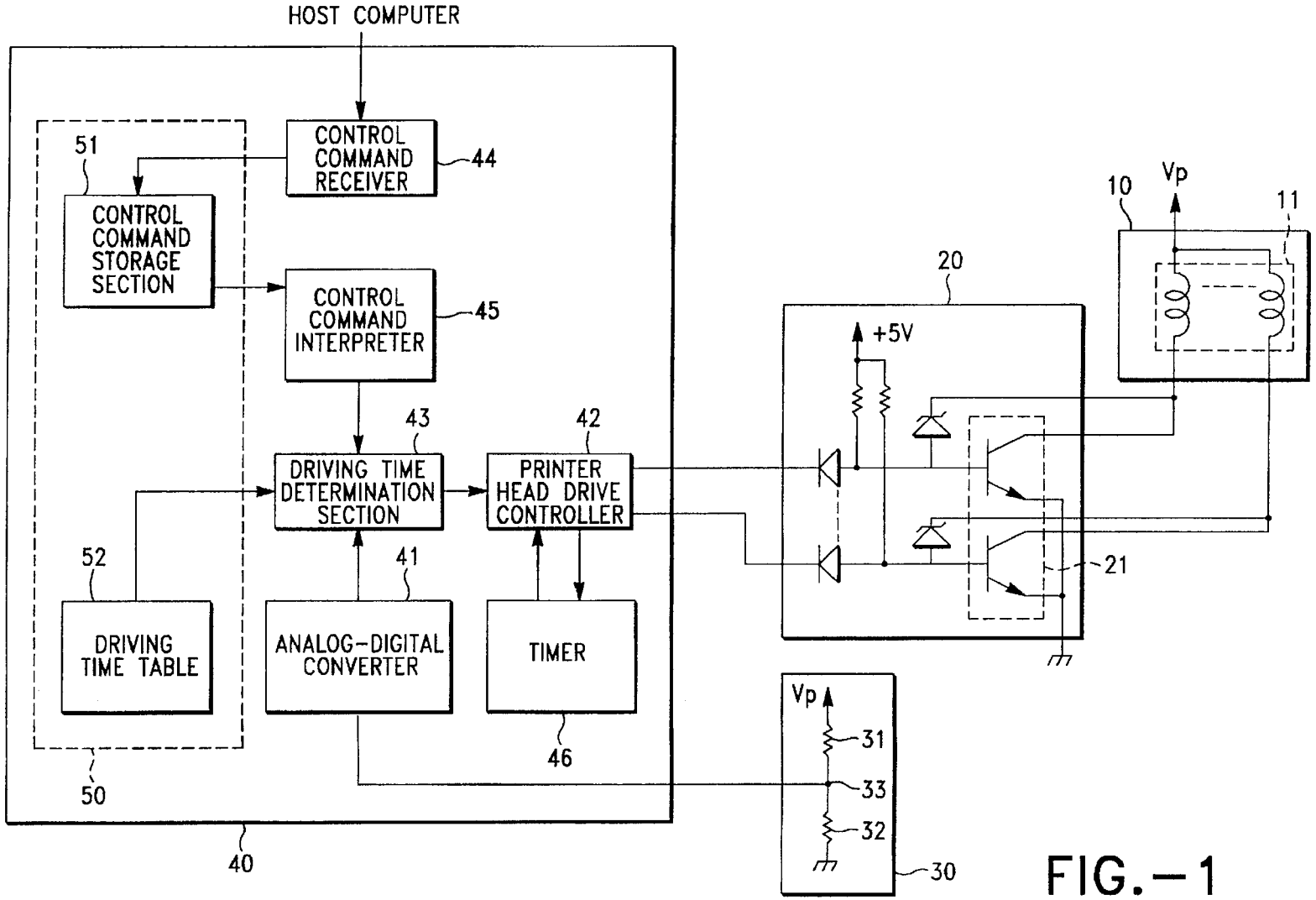
FIG. 1 illustrates a block diagram of a printer constructed and operating according to the principles of the invention.

A first embodiment of a printer constructed and operating according to the principles of the invention, is shown in FIG. 1. The printer in FIG. 1 has a series of head coils 11 housed inside of a print head 10 which are used to actuate dot wires or pins (not shown) for performing dot matrix type impact printing. A print head driver 20 connected to print head 10, is used to provide and control voltage supplied to head coils 11 based on commands from a printer control circuit 40. A voltage measurement section 30 is connected to printer control circuit 40 and measure the pin voltage Vp which is supplied to head coils 11. Printer control circuit 40 performs printing control and communicates control commands received from a host computer (not shown).

Print head driver 20 has an output drive switch 21 which applies the desired print head driving voltage $V_p$ to head coil 11 when activated. An exemplary drive switch 21 comprises a series of one or more power transistors with output nodes connected to one of the head coils, which are selectively switched to activate the transfer of voltage signals to print head coils 11. Therefore, when drive switch 21 is switched to an ON state by a control signal from printer control circuit 40, print head driving voltage $V_p$ is applied to each designated head coil 11 as desired. The application of voltage to coils 11 causes the dot wires to be driven by actuators comprising magnetic circuits, which are not shown, and dot matrix printing to be performed.

Driving voltage measurement section 30 senses or measures fluctuations that occur in the magnitude of driving voltage $V_p$ being applied to head coils 11. To this end voltage measurement section 30 uses two reference resistors 31 and 32, connected in series between source of print head driving voltage $V_p$ and ground. One end of reference resistor 31 is connected to the source of print head driving voltage Vp, while the other end is connected to one end of reference resistor 32. The other end of reference resistor 32 is connected to a ground potential, in relation to the voltage $V_p$. Therefore, a voltage divider circuit is formed by reference resistors 31 and 32, and fluctuations in print head driving voltage $V_p$ are measured as changes in a voltage output at a divider node or measurement point 33, and transferred to printer control circuit 40.

In this embodiment, printer control circuit 40 uses a lower voltage power source which is separate from and operates independent of the power source that generates driving voltage $V_p$. Therefore, the type of voltage divider circuit described above is necessary. Also, by using a voltage divider circuit, the impedance of the side being measured can be increased without negatively impacting the other side, which provides a measure of isolation and protection for the measurement circuit. Furthermore, the integrating circuit formed by the input capacitance of the measured side and the resistance of the voltage divider circuit, acts to eliminate or reduce the impact of any high frequency noise component contained within the driving voltage $V_p$ signal.

Printer control circuit 40 includes a control command receiver 44, which is used to receive control commands output from the host computer and a control command interpreter 45, which is used to decode and interpret the meaning or operational function of control commands being received. A memory unit or element 50 is used to provide temporary or transient storage for received control commands and for storing certain driving time data. Memory unit 50 includes a control command storage section 51 where the received control commands are temporarily stored. After control commands are received and stored, control command interpreter 45 fetches the stored commands from control command storage section 51, interprets the function of each control command. From this interpretation and analysis, interpreter 45 determines the type of recording paper, the print head driving mode, etc., which are to be used according to the function specified by each command.

Printer control circuit 40 employs an analog-digital converter 41 which has an input that is connected node 33 so that it receives the divided voltage level measured at node 33 by print head driving voltage measurement section 30, and converts the analog voltage level or amplitude to a digital output value. Printer control circuit 40 also has a driving time determination section 43, which is used to determine the amount of driving time or driving time interval for coils 11 of print head 10. Driving time determination section 43 makes its determination based on the print head driving mode selected by control command interpreter 45 and the output of analog-digital converter 41, in conjunction with certain driving time intervals stored in a driving time table memory portion 52 of memory 50. The driving time determined or developed by driving time determination section 43 is output to a print head drive controller 42, which in turn has one or more outputs connected to print head controller 20 and controls its operation according to the time values supplied by driving time determination section 43.

Driving time table memory unit 52 contains, or is used to store, one or more tables of driving time values. For each of these tables, corresponding values for print head driving voltage Vp and print head driving time are stored for each driving mode of the printer head. For this exemplary embodiment, memory 52 is used to store two tables of time values, a table A 53 and a table B 54 which correspond to print head driving modes A and B, respectively. Driving time determination section 43 uses the values stored within these driving time tables to establish a desired print head driving time interval which is set or stored in a timer 46. The time set in timer 46 is the period of time over which print head controller 20 should be driven, by print head drive controller 42, to apply voltage to head coils 11, based on both the divided down voltage level, from voltage Vp, as measured at node 33, and the particular print head driving mode as determined by control command interpreter 45.

An exemplary, control command for selecting the print head driving mode that has been found useful for implementing the invention is shown in FIG. 6. As shown in FIG. 6, a command code 60 uses a non-printing character string "GS E" to indicate that it is a command designating a print head driving mode selection, and when control command interpreter 45 reads command code 60, it interprets it as a command for selecting the print head driving mode specified. In command code 60, the characters or character sequence "GS" represents the ASCII code group separator (GS); i.e., it indicates a number or code value 1DH (where H is used to indicate that a hexadecimal number is being used) and "E" indicates an ASCII code 45H.

The basic command code is followed by a command argument or parameter 61, which is typically a one byte code word having a value presented here as a hypothetical value "n". The command argument "n" indicates or specifies the print head driving mode being designated by the command. The value or values expressed by "n" can be predefined in several ways, as known to those skilled in the art. However, for purposes of illustration, in the present embodiment, when n=0, a mode A is selected and when n=1, a mode B is selected. However, "n" can be assigned many values, each of which is used to select a different printing mode.

In this embodiment, for a given print head driving voltage, mode A uses a shorter print head driving time than mode B. That is, assuming that when print head driving voltage Vp equals $V_1$, the print head driving time of mode A with respect to $V_1$ is $T_A$, and the print head driving time of mode B is $T_B$, and $T_A<T_B$.

While parameter "n" was illustrated above as being configured as a one byte value, it will be readily apparent to those skilled in the art that this is not a limitation of the present invention. This parameter or command argument can be configured to occupy two or more bytes of data, as required. Also, only two driving modes, designated as A and B, were used to illustrate this embodiment for purposes of clarity, but this is also not a limitation of the invention, and it is possible to use any number of driving modes, as desired for specific applications. The specific applications for which the printer is to be used determine the types and number of printing modes to be defined by values used for "n", as well as the maximum number of bits used to state the value for "n".

An example of the control command used by the invention for selecting the type recording paper to be used, is illustrated in FIG. 7. In FIG. 7, a command code 70 using a non-printing character string "ESC c0" indicates that this command is a recording paper selection command, and when control command interpreter 45 reads this command code, it interprets a subsequent command argument as a particular recording paper selection. The "ESC" character represents the ASCII code escape; which is indicates 1BH (or 27 in decimal notation), and the "c0" characters represent ASCII codes 63H and 30H, respectively. The following code parameter 71, again presented as hypothetical value "n," specifies the specific recording paper. That is, as before, values for "n" are predefined so that when n=0, roll paper is selected, and when n=1, cut-sheet paper is selected.

As in the case of the print head driving mode, the above parameter was configured as one byte, but it may be two or more bytes as required. In addition, only two types of paper, roll paper and cut-sheet paper, were used in this embodiment for purposes of clarity in designating the print media. However, this is not a limitation of the invention and other types of paper or other print media can be specified as within the teaching s of the invention. The values for "n" are determined according to the required number of recording media or paper types used for the specific application desired for the printer.

An explanation of the method of operation for a printer constructed according to the invention, and configured as described above, is present next. As already explained, the control command sent from the host computer is received by control command receiver 44 of the printer control circuit and is stored in command storage section 51 of memory 50.

Figure 2:
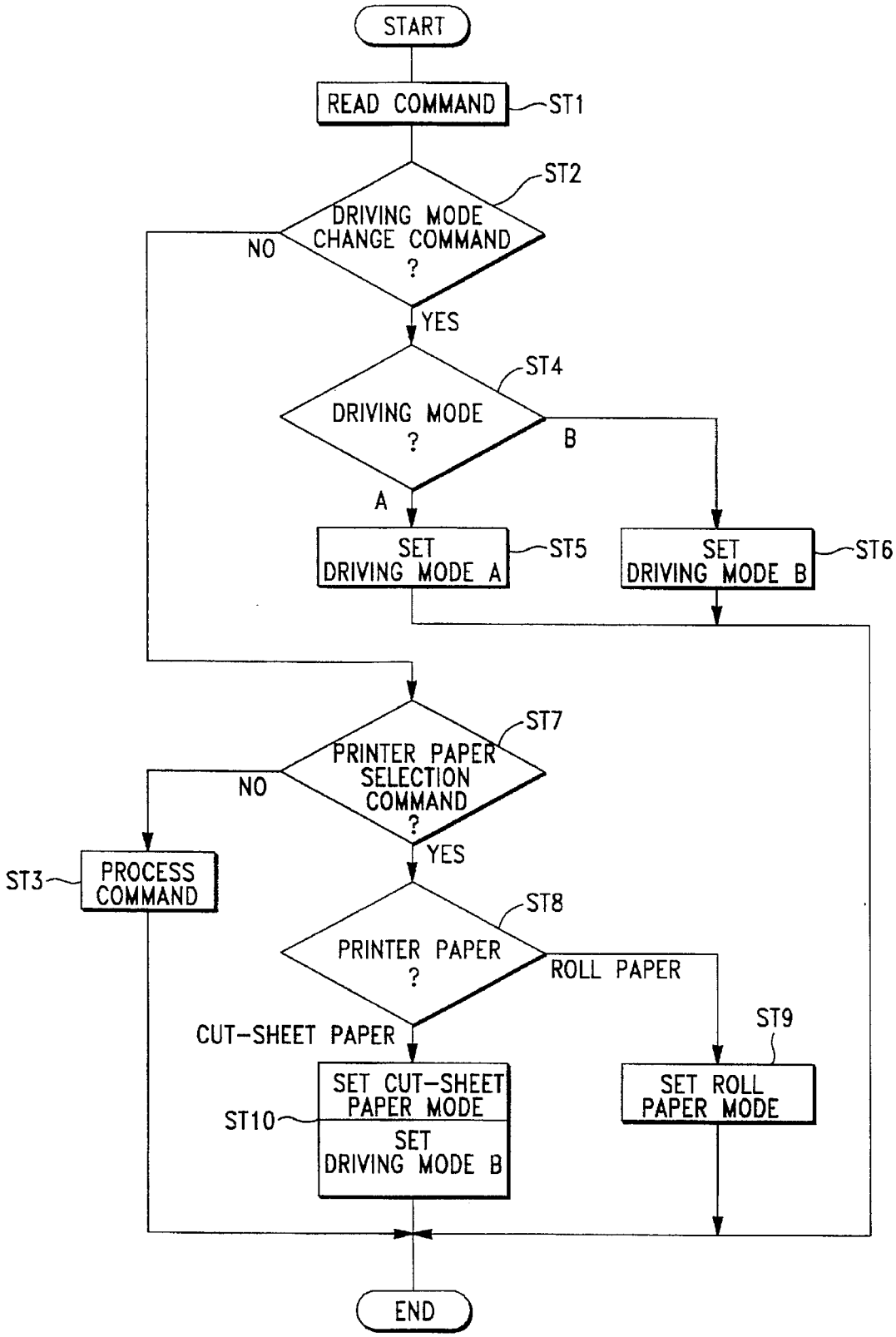
FIG. 2 illustrates a flowchart of steps implemented in operating the printer of FIG. 1.

A flowchart of the steps used when control command interpreter 45 processes either driving mode or recording paper selection commands is illustrated in FIG. 2. In FIG. 2, the control command interpreter first reads out the control command from control command storage section 51 in a step ST1, and then determines whether or not this control command is a driving mode selection command, in a step ST2. If the command being read is not a driving mode selection command, a subsequent determination is made as to whether or not it is a recording paper selection command in a step ST7. If it is also determined in step ST7 that the command is not a recording paper selection command, then the command is not a control command for driving mode selection and processing proceeds to a step ST3 where commands other than those for driving mode selection are executed according to their respective command function. Examples of this latter type of control command include a line feed control command ("LF") or a printing data cancel control command ("CAN").

However, returning to step ST2, if it is determined that the control command is a driving mode selection command, then a determination is also made as to which print head driving mode should be selected in a step ST4. The specific print head driving mode, A or B, is selected in steps ST5 and ST6, according to the value specified by the control command.

If it is determined, in step ST2, that the control command is not a driving mode selection command, then a subsequent determination is made in step ST7 as to whether or not this command is a recording paper selection command. If it is, a determination as to which type of recording paper is being specified by the command is then made in a step ST8. If the recording paper specified by the control command is roll paper, then the printer is set to a roll paper printing mode in a step ST9. More specifically, processing is performed in this step that switches any recording paper transport path or driving mechanism in the printer to a state or mode required for roll paper, or sets the amount by which the recording paper is advanced through the printer for any line feed commands to a value corresponding to the specified roll paper. In this embodiment, driving mode selection is not performed following the setting of the roll paper printing mode. This is done because only two types of paper, single sheet roll paper and copy or multi-layered paper, are assumed to be used. Therefore selection of the driving mode is left for the driving mode selection command as far as roll paper is concerned.

Also, if the recording paper specified by the control command is cut-sheet paper, then the printer is set to a cut-sheet paper printing mode in a step ST10, after which a print head driving mode B is selected. This is done because cut-sheet paper is often copy-type paper and print head driving mode B, which has a longer driving time, is selected to ensure sufficient print quality for all layers of the multi-layered "copy" media.

Figures 9A, 9B, 9C, 11:
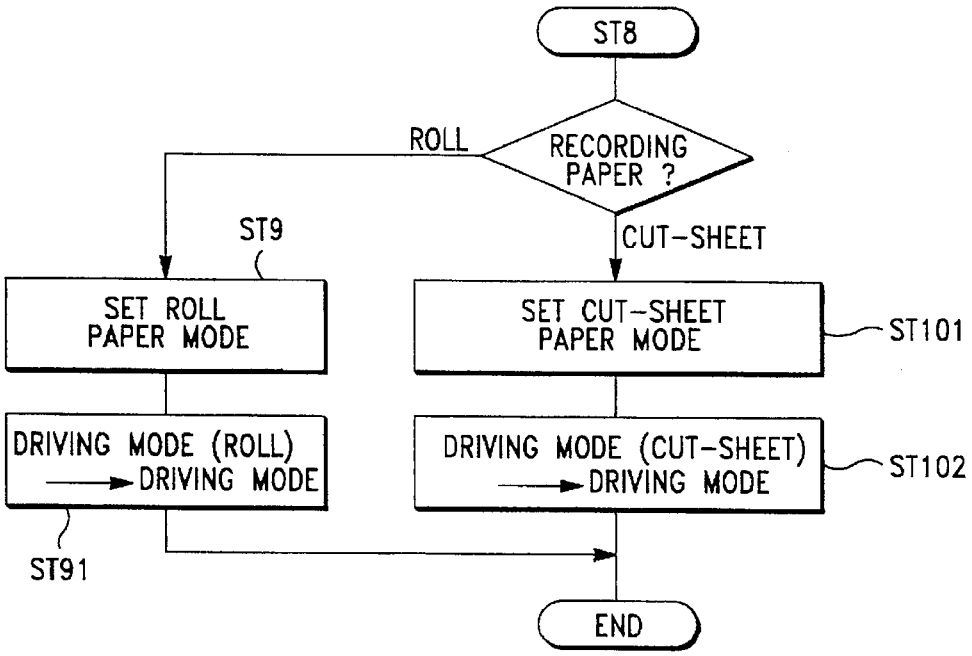
FIGS. 9A, 9B, and 9C show correlations between selected recording media and a corresponding driving mode set in according to operation of the invention.
FIG. 11 illustrates a flowchart of steps implemented to determine which recording paper is to be used.

The relationship between the type of recording paper selected and the driving mode selected in response as shown by the sequence of steps in the flowchart of FIG. 2, is illustrated in FIG. 9A. As can be seen from the flowchart, when single sheet or layer type cut-sheet paper is used, the cut-sheet paper mode and driving mode A can both be selected by selecting driving mode A with the driving mode selection command at this time.

The sequence used to determine the length time used for driving the print head from the measured value of the print head driving voltage, is explained next. The relationship between print head driving voltage Vp, corresponding to a print head driving mode, and an optimum print head driving time was found experimentally, and is presented in graphical form in FIG. 3. In FIG. 3, print head driving voltage Vp is plotted against the horizontal axis, while the optimum print head driving time is plotted along the vertical axis. When print head driving voltage Vp has a value $V_1$, the optimum print head driving time is equal to a value $T_A$ if the print head driving mode is A and equal to $T_B$ if the print head driving mode is B.

Figure 4:
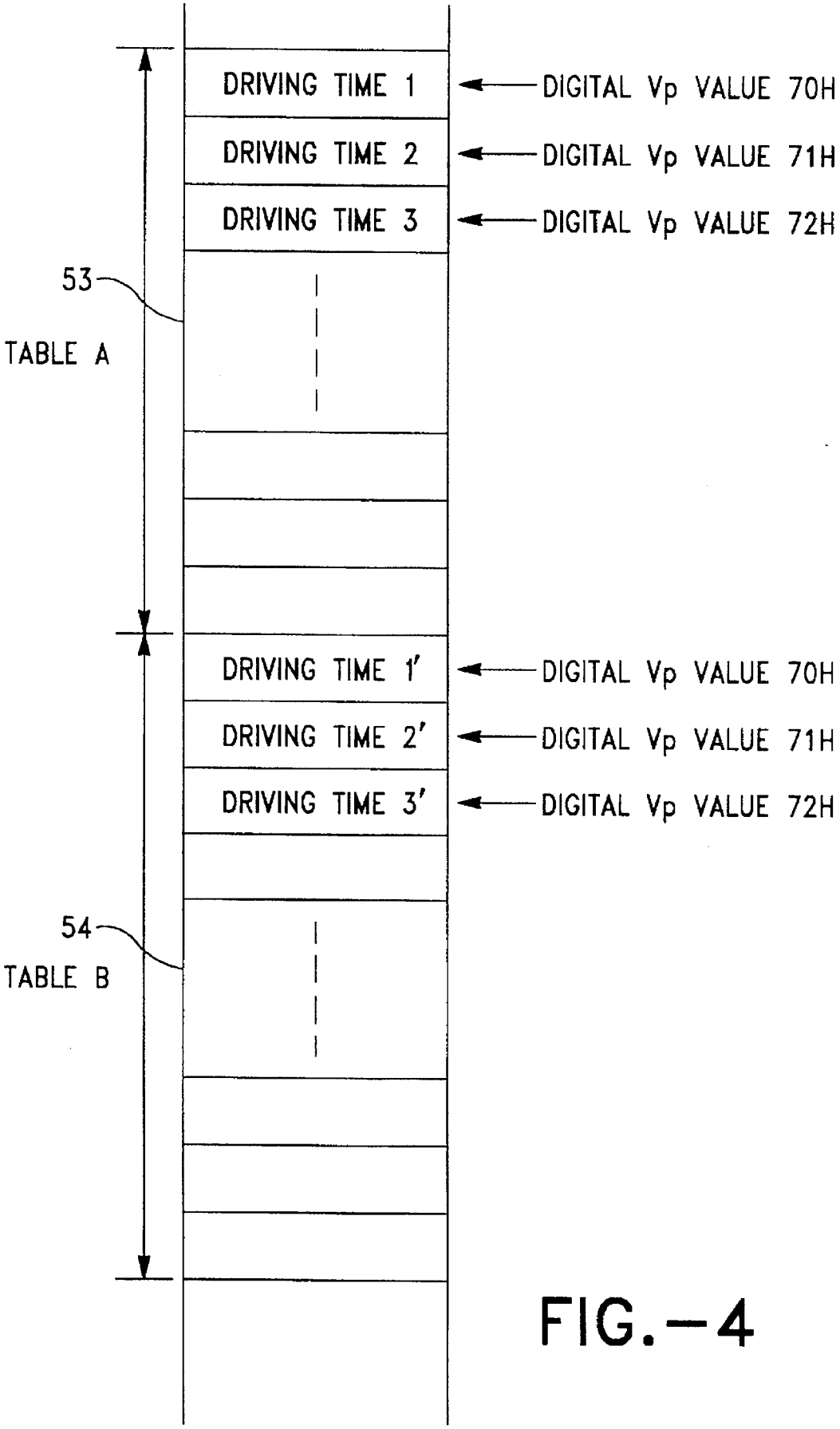
FIG. 4 illustrates a memory map useful for implementing the invention.

As illustrated in the memory map or structure shown in FIG. 4, a series of optimum driving times or periods are stored in memory 52 for use in operating the printer according to the inventive principles. Digital values for the print head driving voltage Vp (actually the value of the divided voltage in this embodiment) and the corresponding optimum print head driving times are stored in a driving time table 52 within memory 50 for each print head driving mode as shown in FIG. 4. In FIG. 4, one portion 53 of memory contains a series of values forming table A whose values correspond to operation in printer driving mode A. A second portion 54 of memory contains a series of values forming table B whose values correspond to operation in driving mode B.

Figure 5:
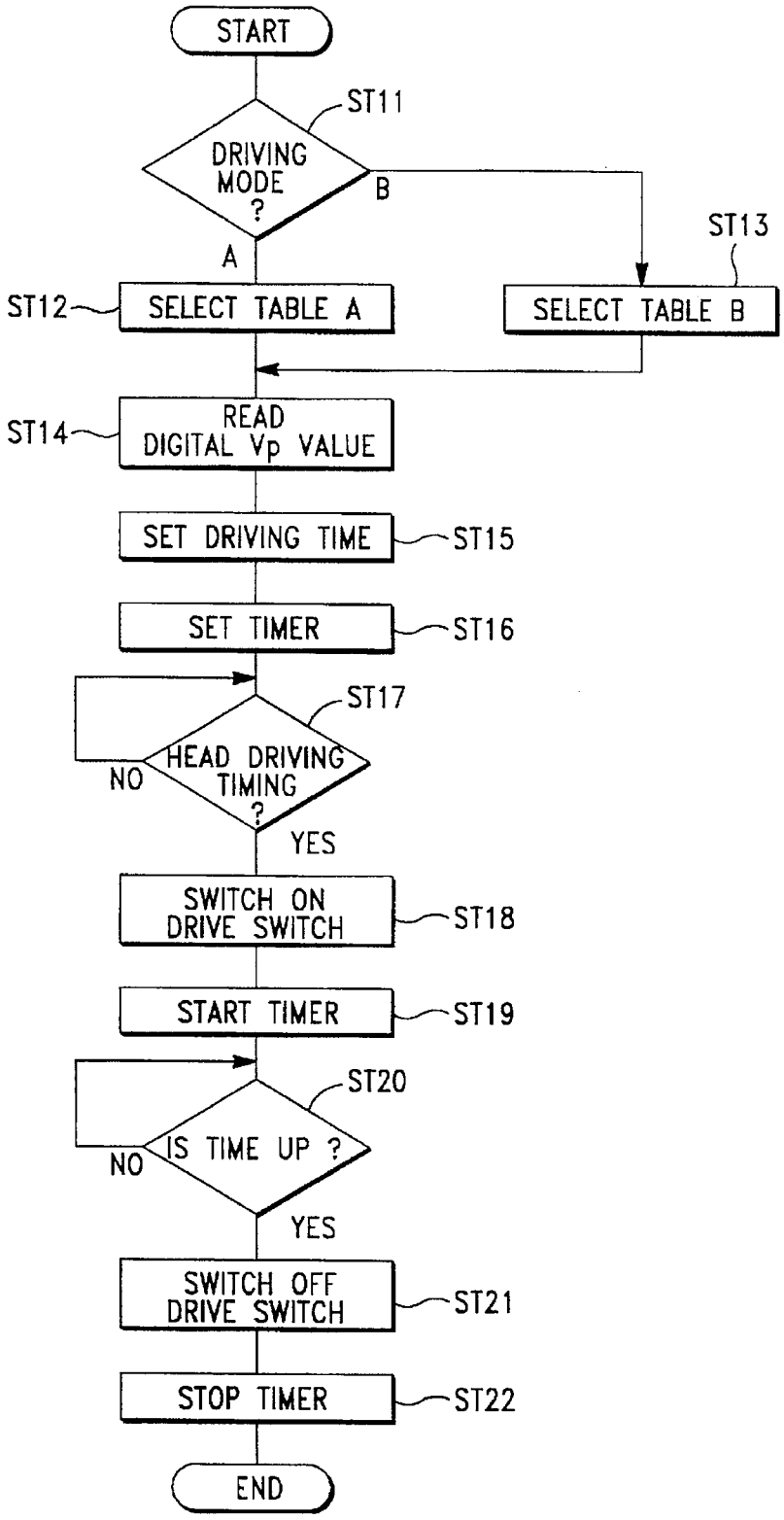
FIG. 5 illustrates a flowchart of steps used in operating the printer of the invention.

The steps executed during operation of the printer for printing one dot on print media are described next in relation to the flowchart illustrated in FIG. 5. As seen in the flowchart of FIG. 5, control command interpreter 45 first determines the print head driving mode in a step ST11. If it is determined in step ST11 that the print head driving mode is A, table A or memory section 53 portion of driving time table 52 is selected for use in a step ST12. Otherwise, if it is determined in step ST11 that the print head driving mode is B, then table B or memory section 54 of driving time table 52 is selected for use in a step ST13.

The digitized print head driving voltage Vp output by analog-digital converter 41 is read next in a step ST14. The driving time from table A or table B, whichever was chosen after step ST11, that corresponds to the voltage read in step ST14 is selected from the chosen table in a step ST15 and then set in timer 46 in a step ST16. Processing then pauses, as required, in a step ST17 to wait for a request to operate print head 10. When operation of print head 10 is desired, driving controller 42 sends a driving signal to print head controller 20 in a step ST18, at which time timer 46 also begins operation in a step ST19. The signal from controller 42 switches drive switch 21 ON, and driving voltage Vp is applied to head coils 11 and printing commences. Processing then waits and checks for completion of the set driving time in a step ST20. When the driving time interval has expired or is completed, the drive signals to print head controller 20 are interrupted or stopped in a step ST21, and timer 46 also stops operation in a step ST22. This printing or formation of one dot by the printer is thus completed and printer operation terminates.

Figure 10:
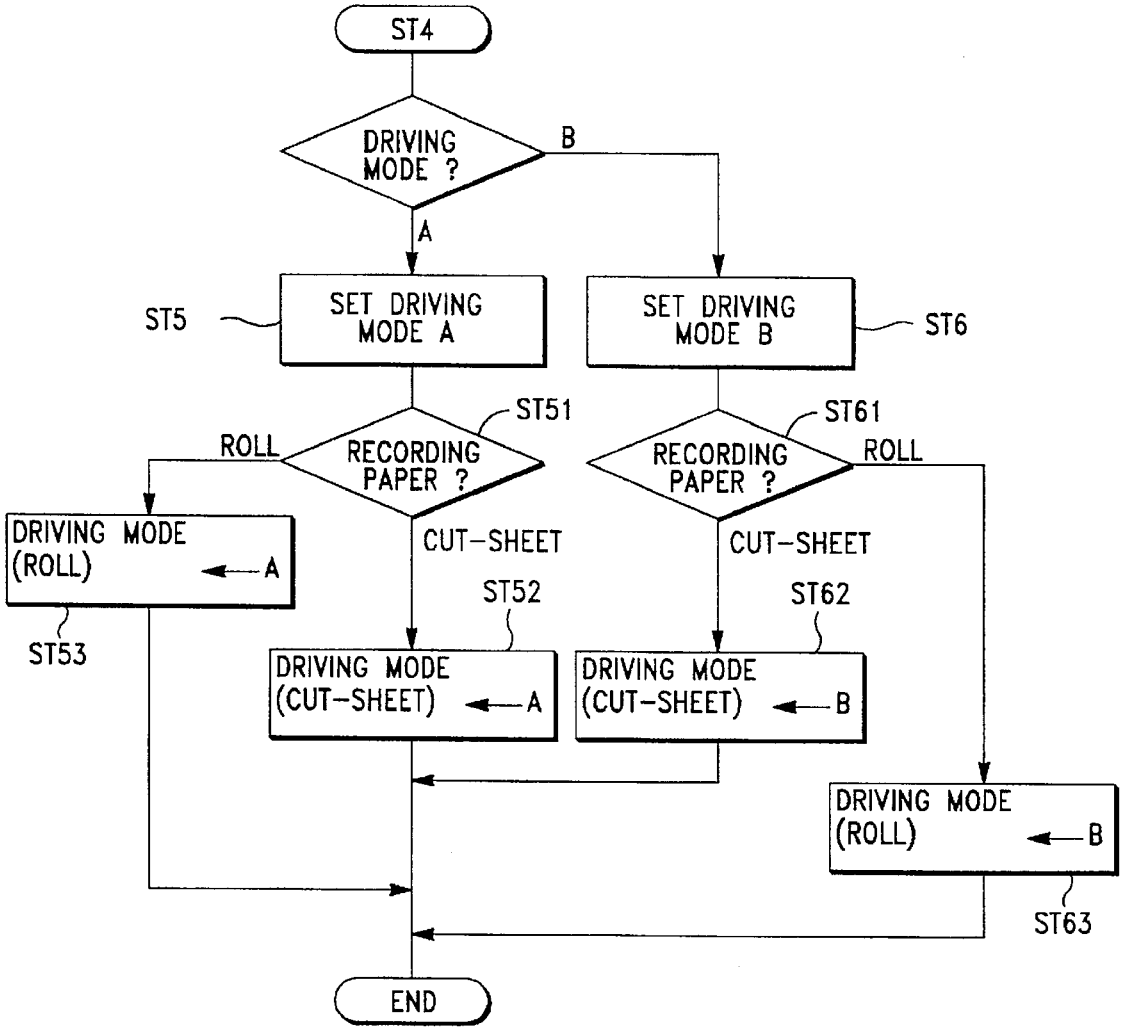
FIG. 10 illustrates a flowchart of steps implemented to select a driving mode according to a second embodiment of the invention.

The sequence of steps used for selecting a driving mode in a printer operating according to a second embodiment of the invention is explained in reference to FIGS. 9 and 10. A flowchart of operating steps that occur after step ST4 of FIG. 2 is executed, in which the print head driving mode is determined, is illustrated in FIG. 10. Here, after the driving mode is set in steps ST5 and ST6, based on the determination as to which driving mode is to be used from step ST4, a determination is made as to which type of recording paper is to be used currently in the printer in steps ST51 and ST61. If roll paper is selected, for example, then the driving mode set in steps ST5 or ST6 is stored as the driving mode corresponding to roll paper in steps ST53 and ST63. Also, when cut-sheet paper is selected, then the driving mode set in steps ST5 or ST6 is stored as the driving mode corresponding to cut-sheet paper in steps ST52 and ST62.

Therefore, when selection of driving mode A is performed by the driving mode selection command after roll paper has been selected, for example, then driving mode A is stored as the appropriate driving mode for use with roll type paper media. Also, if driving mode B is then selected by the driving mode selection command after cut-sheet paper has been selected, then driving mode B is stored as the driving mode that is to be used with cut-sheet paper media. FIG. 9B shows the correlation between the selected recording paper media and a corresponding driving mode which is obtained as a result of this procedure.

A flowchart of steps used in the operation of the printer subsequent to step ST8 in the flowchart of FIG. 2, for determining which recording paper is to be used, is shown in FIG. 11. Based on the determination resulting from the processing of step STS, the printer mode that corresponds to the selected recording paper is set in a step ST9 or a step ST101. Following this, the driving mode corresponding to the selected recording paper is also set in steps ST91 or ST102, respectively. As shown in the correlation in FIG. 9B, driving mode A is set when roll paper is selected and driving mode B is set when cut-sheet paper is selected.

Using this configuration, once the driving mode corresponding to the recording paper has been set, the corresponding optimum driving mode can be automatically selected by just selecting the recording paper to be used.

In the case of this embodiment, the settings shown in FIG. 9C are initially set during an initialization sequence for the printer as the relationship to be used between the selected recording paper and the driving mode to be set by its selection. In this manner, the driving mode with the longer driving time is selected even when no specific driving mode has been set, thus ensuring reliable printing.

Steps executed during operation of the printer used for implementing a third embodiment of the printer are described next in relation to a flowchart illustrated in FIG.

12, which contains many of the same processing steps as previously seen in the flowchart of FIG. 5, and which are accordingly numbered the same. However, the previous embodiments obtained a digital measurement representing the driving voltage Vp prior to switching print head drive switch, or switches depending on the nature of the printing operation, ON. This is seen in FIG. 5 where the digitized print head driving voltage Vp output by analog-digital converter 41 is read in step ST14 before a driving signal is sent to print head controller 20 by driving controller 42 in step ST18. While this processing allows compensation for static fluctuations in driving voltages, as among different printers, alternate operating procedures are preferably employed to account for dynamic voltage variations within a given printer mechanism or structure.

Figure 12:
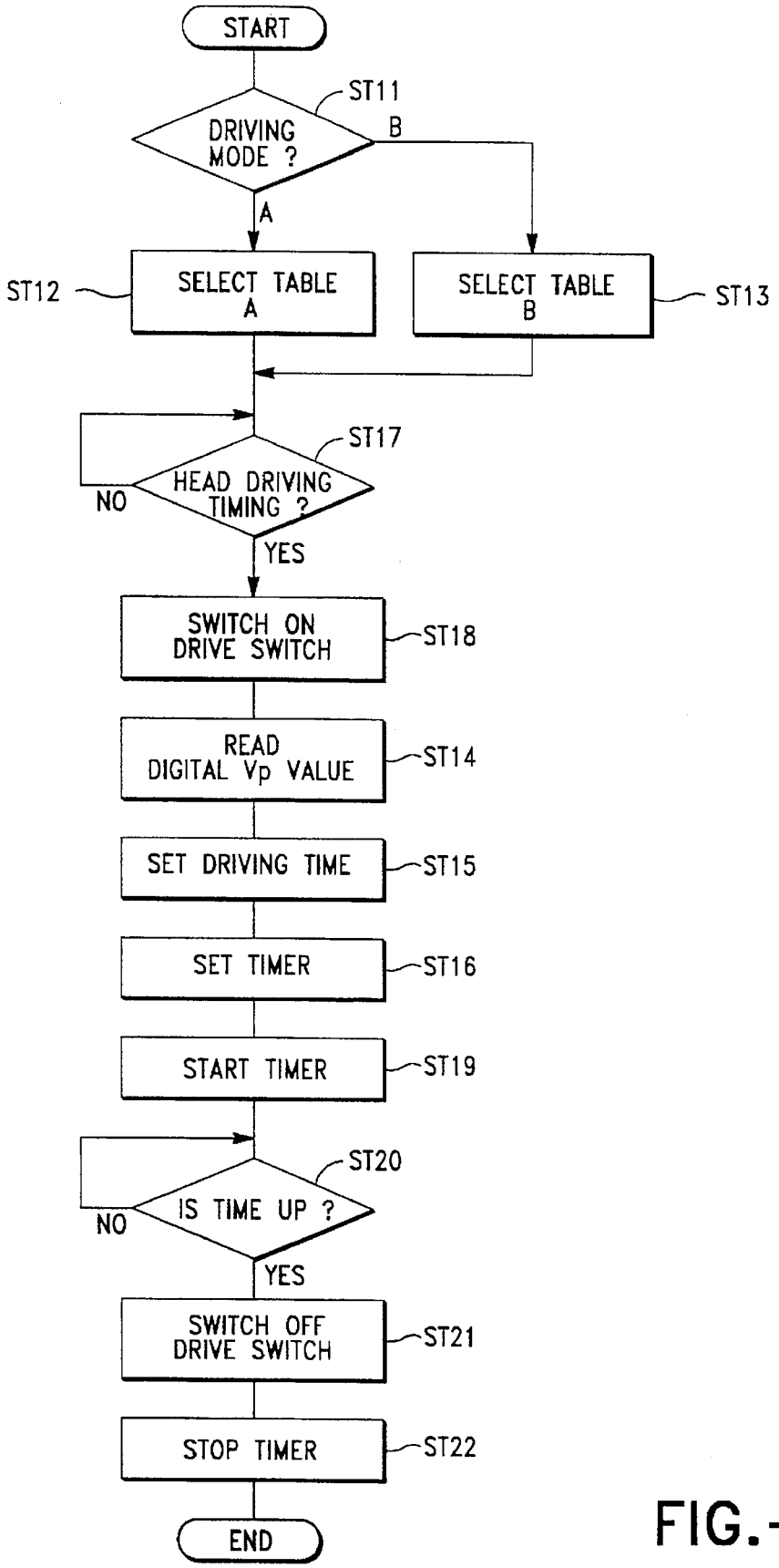
FIG. 12 illustrates a flowchart of steps used in operating a third embodiment of the invention.

As shown in FIG. 12, control command interpreter 45 first determines the print head driving mode in step ST11 and either table A, memory section 53, or table B, memory section 54, portion of driving time table 52 are selected for use in steps ST12 or ST13, respectively, depending on the mode determined in step ST11. Processing then pauses, as required, in a step ST17 to wait for a request to operate print head 10. When operation of print head 10 is desired, driving controller 42 sends a driving signal to print head controller 20 in a step ST18. That is, print head drive switches are turned on by the signal from controller 42, and driving voltage Vp is applied to head coils 11 to commence printing.

The process of powering respective or desired coils in the print head changes the load on the driving voltage source or supply and causes the output voltage to fluctuate or change. Therefore, after turning on any print head drive switches, as desired for the printing task, the digitized print head driving voltage Vp is read from analog-digital converter 41 in step ST14. This provides a readout of the voltage under the then current driving conditions for the print head so that a more proper driving time can be selected to accommodate such conditions.

The measuring step is then followed by selecting the driving time from tables A or B, whichever was chosen, that corresponds to the voltage read in step ST14 in a step ST15 and then setting this value in timer 46 in step ST16. The timer 46 begins operation in step ST19. Processing then pauses and checks for completion of the set driving time in step ST20. When the driving time interval has expired or is completed, the drive signals to print head controller 20 are interrupted or stopped in a step ST21, turning off print head driver switches, and timer 46 is stopped in step ST22. Printing or formation of one or more dots by the printer is thus completed and printer operation terminates.

Since the digital measured voltage value employed in this embodiment represents the actual driving voltage under the respective load or operating conditions, the printer maintains a constant driving energy to the print head irrespective of how many printing wires are driven at a time, That is, a constant energy is maintained regardless of the number of dots to be formed.

There is some amount of delay that occurs between the time when print head power or drive switches are turned on in step ST18, and when the timer is started in step ST19 after the selection of the appropriate time period in steps ST14 through ST16. However, the length of this delay is much shorter than the length of the driving time used, and it should not have a significant impact on the amount of energy being delivered to the print head. However, since this delay period is also fixed or has a constant time delay value, if desired or otherwise necessary, it can easily be compensated for by simply adjusting, shortening, the length of the driving times stored in time table 52 (FIG. 1), or as selected from any other source.

As described above, by using the invention, in addition to being able to change the driving time of the head coils in response to fluctuations in the print head driving voltage, the driving time of the head coils can also be changed by switching the print head driving mode via a control command. This makes it possible to lower printing noise and suppress heat generation by the print head by using a control command to select a print head driving mode with a shorter driving time when the printing noise is otherwise loud or the print head would generate heat because the print head driving time is longer than necessary. Also, when the image quality, capability to form copies, decreases because the driving time is shorter than the required to print on the selected media, the desired print quality can be achieved by selecting a print head driving mode with a longer driving time.

At the same time, when the print head output is required to form copies, as in multi-part paper, the necessary output can be obtained by using the recording media information to select a print head driving mode with a longer driving time. Therefore, the invention makes it possible to perform optimum printing on the recording media without sacrificing print quality.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A printer for selectively printing on at least two types of recording media supplied from a respective media path in response to a media selection command received from a host computer by application of voltage signals to a print head, said printer comprising:

a control command interpreter responsive to the host computer for receiving, interpreting, and distinguishing between (1) a print mode command and (2) the media selection command;

path selection means for selecting the respective media path in accordance with the media selection command interpreted by said control command interpreter to supply the selected recording media;

driving time determination means for determining a driving time for driving said print head, said driving time determination means comprising a look up table for storing a correspondence between the two types of recording media and a respective print mode, wherein the driving time is determined in accordance with the print mode specified by one of:

the print mode command received, interpreted, and distinguished by said control command interpreter and ignoring the received, interpreted, and distinguished media selection command for driving time determination purposes; and an entry in said look up table corresponding to the media selection command received, interpreted, and distinguished by said command interpreter only when no print mode command is received by said control command interpreter; and a print head driver controller for applying the voltage signals to said print head for the driving time determined by said driving time determination means, whenever a printing operation is to be executed by said printer.

2. The printer of claim 1, further comprising receiving means for receiving and temporarily storing the media selection and print mode commands sent from the host computer and for providing the stored commands to said control command interpreter.

3. The printer of claim 1, wherein said driving time determination means comprises a driving time memory that stores driving times corresponding to said plurality of print modes each having differing driving time values, said driving time memory being configured so that it subsequently retrieves stored driving time values based on one of said plural print modes.

4. A printer for selectively printing on at least two types of recording media supplied from a respective media path in response to a recording selection command received from a host computer by application of voltage signals to a dot-matrix type print head, said printer comprising:

a control command interpreter responsive to the host computer for interpreting (1) a print mode command and (2) the media selection command;

path selection means for selecting the respective media path in accordance with the media selection command interpreted by said control interpreter to supply the selected media;

print head driving voltage measurement means for ascertaining the amplitude of voltage used to drive the print head;

driving time determination means for determining a driving time for driving said print head, said driving time determining means, comprising:

a driving time memory that stores driving times corresponding to said plurality of print modes, each having differing driving time values, said driving time memory being configured so that it subsequently retrieves stored driving time values based on one said plural print modes; and a look up table for storing a correspondence between the two types of recording media and respective print mode, wherein the driving time is determined in accordance with the measured voltage and said print mode (1) selected using said look up table and said driving time memory in response to the media selection command interpreted by said control command interpreter or (2) designated by the print mode command interpreted by said control command interpreter; and a print head driver controller for applying the voltage signals to said dot-matrix print head for the driving time determined by said driving time determination means, whenever a printing operation is to be executed by said printer.

5. The printer of claim 4 further comprising an analog-digital conversion means for converting the voltage amplitude measured by said print head driving voltage measurement means to a digital value.

6. The printer of claim 4 wherein said driving time memory comprises at least one driving time table that stores driving times corresponding to said plurality of print modes and driving times corresponding to the measured voltage.

7. A printer for selectively printing on at least two types of recording media supplied from a respective media path in response to a media selection command received from a host computer by application of voltage signals to a dot-matrix type print head, said printer comprising:

a control command interpreter responsive to the host computer for interpreting (1) a print mode command and (2) the media selection command;

path selection means for selecting the respective media path in accordance with the media rejection command interpreted by said control interpreter to supply the selected media;

print head driving voltage measurement means for ascertaining the amplitude of voltage used to drive the print head;

driving time determination means for determining a driving time for driving said print head, said driving time determining means comprising a look up table for storing a correspondence between the two types of recording media and a respective print mode, wherein the driving time is determined in accordance with the voltage measured by said print head driving voltage measurement means and both said print modes (1) selected using said look up table in response to the media selection command interpreted by said control command interpreter or (2) designated by the print mode command interpreted by said control command interpreter; and a print head driver controller for applying the voltage signals to said dot-matrix print head for the driving time determined by said driving time determination means, whenever a printing operation is to be executed by said printer.

8. The printer of claim 7, wherein said driving time memory comprises at least one driving time table that stores driving times corresponding to a plurality of print modes and driving times corresponding to the measured voltage.

9. The printer of claim 8 further comprising an analog-digital conversion means for converting the voltage amplitude measured by said print head driving voltage measurement means to a digital value.

10. A method for controlling the operation of a printer that selectively performs printing on at least two types of recording media supplied from a respective media path in response to a media selection command received from a host computer by application of voltage signals to a print head using a print head driver, comprising the steps of:

receiving, interpreting, and distinguishing between (1) a print mode and (2) the media selection command;

selecting the respective media path for supplying one of the two types of media in accordance with the media selection command interpreted in said interpreting step;

storing data comprising a correspondence between the two types of recording media and a respective print mode;

determining a time interval for driving the print head in accordance with the print mode, the print mode being specified by one of:

the print mode received, interpreted, and distinguished in said receiving, interpreting, and distinguishing step and ignoring the received, interpreted, and distinguished media selection command for driving time determination purposes; and said data corresponding to the media selection command received, interpreted, and distinguished in said receiving, interpreting, and distinguishing step only when no print mode is received in said receiving and interpreting step; and activating operation of said print head driver for the time interval determined in said determining step.

11. The control method of claim 10 further comprising the step of temporarily storing the media selection and print mode commands sent from the host computer.

12. The control method of claim 10 further comprising the step of storing driving times corresponding to said plurality of print modes each having differing driving time values in a driving time memory that is configured to subsequently retrieve stored driving time values based on one of said plural print modes.

13. A method for controlling the operation of a printer that selectively performs printing on at least two types of recording media supplied from a respective media path in response to a media selection command received from a host computer by application of voltage signals to dot-matrix type print head using a print head driver, comprising the steps of:

receiving and interpreting (1) a print mode command and (2) the media selection command;

selecting the respective media path for supplying one of the two types of media in accordance with the media selection command interpreted in said interpreting step;

storing data comprising a correspondence between the two types of recording media and a respective print mode;

measuring an amplitude of voltage used to drive the print head;

determining a time interval for driving the print head in accordance with both said measured voltage and said print mode (1) designated by the interpreted print mode command or (2) selected using said data in response to the media selection command interpreted in said interpreting step and stored in said storing step; and activating operation of said print head driver for the time interval determined in said determining step.

14. The control method of claim 13 further comprising the step of converting the voltage amplitude measured by said print head driving voltage measurement means to a digital value.

15. The control method of claim 14 further comprising the step of:

updating said data comprising a correspondence between the two types of recording media and a respective print mode when the print mode command is executed after the media selection command, so as to cause a print mode selected by the print mode command and the media selection command to match.

16. The control method of claim 15 further comprising the step of initializing said conversion while initializing the printer.

17. A printer for selectively printing on two types of recording media in response to a media selection command received from a host computer by application of voltage signals to a dot-matrix type print head, said printer comprising:

a control command interpreter responsive to the host computer for receiving interpreting and distinguishing between (1) a print mode command and (2) the media selection command;

driving time determination means for determining a driving time for driving said print head, said driving time determining means comprising a look up table for storing a correspondence between the two types of recording media and a respective print mode, wherein the look up table is changeable by one print mode command interpreted by said control interpreter, wherein the driving time is determined in accordance with the print mode specified by one of:

the print mode command received, interpreted, and distinguished by said command interpreter and ignoring the received, interpreted, and distinguished media selection command for driving time determination purposes; and an entry in said look up table corresponding to the media selection command interpreted and distinguished by said command interpreter when no print mode command is received by said command interpreter; and a print head controller for applying the voltage signals to the dot-matrix print head for the driving time determined by said driving time determination means.

18. The printer of claim 17, further comprising receiving means for receiving and temporarily storing the media selection and print mode commands sent from the host computer and for providing the stored commands to said control command interpreter.

19. The printer of claim 18, further comprising an analog-digital conversion means for converting the voltage amplitude measured by said print head driving voltage measurement means to a digital value.

20. A printer for selectively printing on two types of recording media in response to a media selection command received from a host computer by application of voltage signals to a dot-matrix type print head, said printer comprising:

a control command interpreter responsive to the host computer for interpreting (1) a print mode command and (2) the media selection command;

print head driving voltage measurement means for ascertaining the amplitude of voltage used to dive the print head;

driving time determination means for determining a driving time for driving said print head, said driving time determining means comprising a look up table for storing a correspondence between the two types of recording media and a respective print mode, wherein the look up table is changeable by one print mode command interpreted by said control interpreter, wherein the driving time is determined in accordance with both the measured voltage and the print mode selected using said look up table in response to the media selection command interpreted by said command interpreter and designated by the print mode command interpreted by said command interpreter; and a print head controller for applying the voltage signals to the dot-matrix print head for the driving time determined by said driving time determination means.

21. The printer of claim 20, wherein said driving time memory comprises at least one driving time table that stores driving times corresponding to said plurality of print modes and driving times corresponding to the measured voltage.

22. A printer for selectively printing on two types of recording media in response to a media selection command received from a host computer by application of voltage signals to a dot-matrix type print head, said printer comprising:

a control command interpreter responsive to the host computer for interpreting (1) a print mode command: and (2) the media selection command;

print head driving voltage measurement means for ascertaining the amplitude of voltage used to drive the print head;

driving time determination means for determining a driving time for driving said print head, said driving time determining means comprising a look up table for storing a correspondence between the two types of recording media and a respective print mode, wherein the look up table is changeable by one print mode command interpreted by said control interpreter, wherein the driving time is determined in accordance with the voltage measured by said print head driving voltage measurement and both the print modes (1) selected using said look up table in response to the media selection command interpreted by said command interpreted and designated by the print mode command interpreted by said command interpreter; and a print head controller for applying the voltage signals to the dot-matrix print head for the driving time determined by said driving time determination means.

23. The printer of claim 22, wherein said driving time memory comprises at least one driving time table that stores driving times corresponding to a plurality of print modes and driving times corresponding to the measured voltage.

24. The printer of claim 23, further comprising an analog-digital conversion means for converting the voltage amplitude measured by said print head driving voltage measurement means to a digital value.

25. A method of controlling the operation of a printer that selectively performs printing on at least two types of recording media in response to a media selection command received from a host computer by application of voltage signals to a dot-matrix type print head using a print head driver comprising the steps of:

receiving and interpreting (1) a print mode command, and (2) the media selection command;

storing data comprising a correspondence between the two types of recording media and a respective print mode;

updating the data stored in said storing step in accordance with one interpreted print mode command;

determining a driving time for driving the print head in accordance with the print mode (1) designated by the interpreted print mode command and (2) updated in said updating step; and activating operation of the print head driver for the driving time interval determined in said determining step.

26. A printer for selectively printing on at least two types of recording media supplied from a respective media by application of voltage signals to a print head, the signals including at least two print modes in which a driving time for driving the print head is different from each other, said printer comprising:

a control command interpreter responsive to the host computer for receiving and interpreting a first command for designating a recording media from said at least two types of recording media and a second command for designating a print mode from said at least two print modes;

path selection means for selecting the media path corresponding to the recording media selected in accordance with said first command received and interpreted by said control command interpreter to supply the selected recording media to the print head;

driving time determination means for determining the driving time in accordance with a print mode, said driving time determination means comprising a conversion means for storing a correspondence between the at least two types of recording media and a respective print mode and for outputting the print mode corresponding to the selected recording media, wherein the correspondence between the at least two types of recording media and a respective print mode is updated in accordance with said second command so that the print mode output by said conversion means matches the print mode designated by said second command; and a print head driver controller for applying the voltage signals to said print head for the driving time determined by said driving time determination means, whenever a printing operation is to be executed by said printer.

* * * * *

UNITED STATES PATENT AND TRADEMARK OFFICE

CERTIFICATE OF CORRECTION

| | | |
|---|---|---|
| PATENT NO. | : | 5,639,169 |
| DATED | : | June 17, 1997 |
| INVENTOR(S) | : | Kazuhisa Aruga |

It is certified that errors appear in the above identified patent and that said Letters Patent is hereby corrected as shown below:

Column 13, line 18, change "recording" to --media--.

Column 16, line 29, change "dive" to --drive--.

Column 16, line 57, change ":" to --,--.

Column 17, line 8, change "interpreted" to --interpreter--.

Signed and Sealed this

Sixteenth Day of December, 1997

*Attest:*

Bruce Lehman

BRUCE LEHMAN

*Attesting Officer*

*Commissioner of Patents and Trademarks*